US008963723B2

(12) United States Patent
Snodgrass

(10) Patent No.: US 8,963,723 B2
(45) Date of Patent: Feb. 24, 2015

(54) KITCHEN SANITIZATION COMPLIANCE MONITORING SYSTEM

(71) Applicant: UltraClenz, LLC, Jupiter, FL (US)

(72) Inventor: David Snodgrass, Jupiter, FL (US)

(73) Assignee: Ultraclenz, LLC, Jupiter, FL (US)

( * ) Notice: Subject to any disclaimer, the term of this patent is extended or adjusted under 35 U.S.C. 154(b) by 284 days.

(21) Appl. No.: 13/657,466

(22) Filed: Oct. 22, 2012

(65) Prior Publication Data

US 2013/0113619 A1 May 9, 2013

Related U.S. Application Data

(60) Provisional application No. 61/549,581, filed on Oct. 20, 2011.

(51) Int. Cl.

| | |
|---|---|
| ***G08B 23/00*** | (2006.01) |
| ***G08B 21/02*** | (2006.01) |
| ***G07C 11/00*** | (2006.01) |

(52) U.S. Cl.

CPC ..... *G08B 21/02* (2013.01); *G07C 11/00* (2013.01)

USPC ..... 340/573.3; 340/5.61; 340/539.11; 705/7.42

(58) Field of Classification Search

CPC ..... G08B 21/02; G07C 9/00007

See application file for complete search history.

(56) References Cited

U.S. PATENT DOCUMENTS

| | | | | |
|---|---|---|---|---|
| 5,863,497 | A * | 1/1999 | Dirksing | 422/28 |
| 2004/0090333 | A1* | 5/2004 | Wildman et al. | 340/573.1 |
| 2006/0132316 | A1* | 6/2006 | Wildman et al. | 340/573.1 |
| 2008/0084315 | A1* | 4/2008 | Pittz | 340/573.1 |
| 2009/0189759 | A1* | 7/2009 | Wildman et al. | 340/539.12 |
| 2010/0155416 | A1* | 6/2010 | Johnson | 222/23 |
| 2010/0173581 | A1* | 7/2010 | Dolan | 455/39 |
| 2010/0231385 | A1* | 9/2010 | Melker et al. | 340/540 |
| 2010/0265059 | A1* | 10/2010 | Melker et al. | 340/539.11 |
| 2010/0328443 | A1* | 12/2010 | Lynam et al. | 348/77 |
| 2011/0068930 | A1* | 3/2011 | Wildman et al. | 340/573.1 |
| 2011/0196720 | A1* | 8/2011 | Guten et al. | 705/7.42 |
| 2011/0273298 | A1* | 11/2011 | Snodgrass et al. | 340/573.1 |
| 2011/0316703 | A1* | 12/2011 | Butler et al. | 340/573.1 |
| 2013/0025714 | A1* | 1/2013 | Hermann | 137/551 |
| 2013/0215245 | A1* | 8/2013 | Haidegger et al. | 348/77 |

* cited by examiner

*Primary Examiner* — Hai Phan
*Assistant Examiner* — Ojiako Nwugo
(74) *Attorney, Agent, or Firm* — Lucas & Mercanti, LLP; Peter J. Phillips

(57) ABSTRACT

A kitchen sanitization compliance monitoring system comprises kitchen staff badges, food prep table beacons associated with food prep tables or areas, dispenser beacons associated with sanitization dispensers, and a central unit for wirelessly communicating with the badges.

20 Claims, 13 Drawing Sheets

Welcome to UltraClenz

Please select your installation type.

Quick Links

Click for Dashboard

Click for System State

New Location

Start New Location Wizard

Existing Location

Add Device

Edit Device

View Data

FIGURE 6

Events

Dispense Events

Show 10 entries

| Device | Type | Nonce | FRID | FRT | FRQ | DT | ET |
|---|---|---|---|---|---|---|---|
| 300001E | Sanitizer | 121 | 9520009 | 09.56.00 11/01/2010 | 164 | 1 | 57655359 |
| 3E00019 | Sanitizer | 21 | 9520009 | 15.43.33 10/26/2010 | 107 | 1 | 57530611 |
| 3000019 | Sanitizer | 19 | 9520009 | 15.14.33 10/16/2010 | 93 | 1 | 57528873 |
| 3000019 | Sanitizer | 18 | 9520009 | 15.14.10 10/26/2010 | 133 | 1 | 57528615 |
| 3000D1E | Sanitizer | 28 | 9520009 | 13.49.45 10/23/2010 | 152 | 1 | 57523784 |
| 300001E | Sanitizer | 27 | 9520009 | 13.49.42 10/26/2010 | 173 | 1 | 57523782 |
| 300001E | Sanitizer | 20 | 9520009 | 08.12.25 10/28/2010 | 191 | 1 | 57503545 |
| 3000019 | Sanitizer | 10 | 9520009 | 07.44.40 10/26/2010 | 55 | 1 | 57501855 |
| 3000019 | Sanitizer | 8 | 9520009 | 07.15.51 10/26/2010 | 92 | 1 | 57500151 |
| 3000019 | Sanitizer | 7 | 9520009 | 07.15.49 10/26/2010 | 103 | 1 | 57500149 |

Showing 1 to 10 of 893 entries

Heartbeat Events

Show 10 entries

| Device | Type | Nonce | FRID | FRT | FRQ | DT | NHID | NHQA | GD | PS |
|---|---|---|---|---|---|---|---|---|---|---|
| 300001E | Sanitizer | 147 | 9520009 | 11.41.47 11/02/2010 | 166 | 1 | 9520009 | 208 | 1 | 0 |
| 3000019 | Sanitizer | 137 | 9520009 | 11.38.82 11/02/2010 | 114 | 1 | 9520009 | 122 | 1 | 0 |
| 3000031 | Sanitizer | 38 | 9520009 | 11.30.49 11/02/2010 | 127 | 1 | 9520009 | 160 | 1 | 0 |
| 3000028 | Sanitizer | 14 | 9520000 | 10.63.02 11/02/2010 | 191 | 1 | 9520009 | 200 | 1 | 0 |
| 300001E | Sanitizer | 145 | 9520009 | 10.41.47 11/02/2010 | 177 | 1 | 9520009 | 207 | 1 | 0 |
| 3000019 | Sanitizer | 136 | 9520009 | 10.38.02 11/02/2010 | 123 | 1 | 9520009 | 120 | 1 | 0 |
| 3000031 | Sanitizer | 37 | 9520009 | 10.30.49 11/02/2010 | 130 | 1 | 9520009 | 160 | 1 | 0 |
| 3000028 | Sanitizer | 13 | 9520009 | 09.53.02 11/02/2010 | 151 | 1 | 9520009 | 201 | 1 | 0 |
| 300001E | Sanitizer | 145 | 9520009 | 09.41.47 11/02/2010 | 190 | 1 | 9520009 | 207 | 1 | 0 |

FIGURE 7

| | | | | | | | | | | |
|---|---|---|---|---|---|---|---|---|---|---|
| 3000019 | Sanitizer | 135 | 9520009 | 09:38.02 11/02/2010 | 107 | 1 | 9520009 | 120 | 1 | 0 |

Showing 1 to 10 of 15,543 entries

Generic Events

Show 10 entries

| Gateway | Device | Nonce | ET | Event Type | Battery Status | User ID (hex) |
|---|---|---|---|---|---|---|
| | | | 13.42.21 | 8 = Override | | |
| 9520009 | 2010002 | 75 | 01/01/2009 | Mode timeout | 92% | |
| | | | 11.34.59 | 4 = Unsanitary | | |
| 9520009 | 2010002 | 68 | 10/26/2010 | Room Exit | 92% | |
| | | | 11.34.44 | 2 = Unsanitary | | |
| 9520009 | 2010002 | 67 | 10/26/2010 | Room Entry | 92% | |
| | | | 11.28.25 | 2 = Unsanitary | | |
| 9520009 | 2010002 | 66 | 10/26/2010 | Room Entry | 92% | |
| | | | 11.07.50 | 4 = Unsanitary | | |
| 9520009 | 2010002 | 64 | 10/26/2010 | Room Exit | 92% | |
| | | | 11.07.39 | 4 = Unsanitary | | |
| 9520009 | 2010002 | 63 | 10/26/2010 | Room Exit | 92% | |
| | | | 11.06.59 | 2 = Unsanitary | | |
| 9520009 | 2010002 | 62 | 10/26/2010 | Room Entry | 92% | |
| | | | 11.05.51 | 4 = Unsanitary | | |
| 9520009 | 2010002 | 61 | 10/26/2010 | Room Exit | 92% | |
| | | | 11.05.41 | 2 = Unsanitary | | |
| 9520009 | 2010002 | 60 | 10/26/2010 | Room Entry | 92% | |
| | | | 10.21.47 | 4 = Unsanitary | | |
| 9520009 | 2010002 | 59 | 10/26/2010 | Room Exit | 92% | |

Showing 1 to 10 of 1,266 entries

Lost Events

FIGURE 7 (CONT'D)

Add Device to Gateway

Device Information

Device ID:
3000019

Device name:
TF Dispenser - wood

Facility Information

Select Facility:
UltraClenz - Engineering & Production

Gateway

Select Gateway:
09520009

Location Information

Wing:
north

Floor:
1st

Department:
administration

Room:
conference room

Extra Information

Unit Type

- o Manual Dispenser
- ◉ Touch Free Dispenser
- o Door Sintenel w/ RFID
- o Door Sintenel Product Type:
Foam / Sanitizer Product Name:
generic foaming sanitizer Save

FIGURE 8

KITCHEN SANITIZATION COMPLIANCE MONITORING SYSTEM

CROSS-REFERENCE TO RELATED APPLICATIONS

This application is a non-provisional of provisional application Ser. No. 61/549,581 filed Oct. 20, 2011, which is incorporated by reference herein.

BACKGROUND OF THE INVENTION

The present invention relates to a kitchen sanitization compliance monitoring system for a commercial kitchen environment such as a QSR (quick service restaurant), Restaurant, Food Processing Plant and particularly to a system to specifically target the hygienic state of waiters, cooks or chefs when interacting with raw or cooked food located on a food prep table or in a defined food prep area.

The term, "sanitization" as used herein, refers to using sanitizer, or performing a hand-wash procedure. The handwash procedure may be preferred using a sink and dispenser, including of the type disclosed in U.S. Pat. No. 6,426,701 to Levy, which is incorporated herein by reference. The handwash procedure monitored may be of the procedure disclosed in the Levy patent.

Kitchen sanitization compliance monitoring systems are currently not available in the marketplace. The current system design focuses on reducing or eliminating the number of occurrences of pathogens transferred from one raw or cooked food table to another via cooks, chefs or waiters in a commercial kitchen environment.

As used herein, the terms, "cooks", "waiters", "chefs", "users", "staff", "badge wearer", "wearer" and "persons" are intended to be synonymous, and include any persons in a commercial kitchen environment having the potential to spread pathogens, bacteria, etc., including not only kitchen personnel and the like, but also custodians, maintenance and other personnel, etc., and any others who are in a commercial kitchen.

SUMMARY OF THE INVENTION

In one form, the invention relates to monitoring whether a kitchen staff has washed or sanitized his hands in a commercial kitchen where the staff has exposure to different foods. The staff would wear a badge which has three different colored lights to indicate the cleanliness state of the hands of the wearer of the badge, red=contaminated (exposure to two or more different foods after a handwash), yellow=caution (exposure to only one type of food after a handwash) and green=sanitized (exposure to no food after a handwash). The yellow or caution state may indicate that the user should sanitize/wash within a certain time period.

Each food prep table would have an associated prep table beacon which wirelessly communicates with a badge within a close range, to detect the identity of the badge, and to detect and change the badge's state (from green to yellow, or from yellow to red).

Each handwash or sanitizer station would have an associated handwash beacon to wirelessly communicate with a badge when in close proximity, to detect the badges identity, and to detect and change the badge state (from yellow or red, to green after a handwash procedure).

Whenever a user washes his hands at a handwash or sanitizer station, the handwash beacon would detect the badge identity and state, and the handwash beacon would cause the badge state to reset to green (from yellow or red).

If a user gets near a raw or cooked food prep table, the prep table beacon would detect the badge identity and state, and the prep table beacon would cause a green badge state to change to yellow, and if already in yellow because of earlier close proximity to a different food prep table beacon without an interim handwash, the prep table beacon would cause the badge state to change from yellow to red.

The prep table beacons and dispenser beacons can communicate with a central monitoring unit which date stamps the communications received, and knows each of the badges' identities and when each badge changes from one state to another, to monitor the compliance of each badge wearer.

An audible alert may be triggered by the following:

(1) a non-compliant event which triggers the audible alert to activate continuously at certain intervals until a compliance event occurs (wash, sanitize); and (2) when exiting a prep table proximity boundary, the audible alert will activate one time reminding/warning the staff that a compliant event needs to occur.

The objective of the badge wearer is to never reach a red=contaminated state. If a user is in a yellow state, indicating a single food exposure, as soon as he leaves that food prep table he should wash and get his badge changed from yellow to green, and not come close to different foods and reach red.

The dispenser beacon, which may be attached to a manual or touch-free dispenser, will set the kitchen staff badge to the compliant state when activated. The dispenser beacon may be provided with functional status LEDs as follows:

Green: one blink when speaking to a badge

Red: two blinks means dead battery, one blink, low battery

Red/Green: failed to communicate to the badge

The dispenser beacon may be provided with a buzzer (Piezo), which is triggered by a successful transaction with the kitchen staff.

The prep table antenna/beacon defines the proximity threshold/boundary of the kitchen staff around the prep table, while the beacon communicates with the badge. The beacon will recognize when a kitchen staff has entered or is within the proximity boundary, and trigger a raw or cooked food contact event. It will then determine the badge's current compliant state. At this point, one of the following will occur:

If the kitchen staff badge is in the compliant (green) state, entering the proximity boundary will change the badge to a cautionary state (green-to-yellow).

If the badge is in a cautionary (yellow) state, entering the proximity boundary will change the badge to a non-compliant red state. The beacon buzzer will activate (yellow-to-red).

If the badge is already in a non-compliant (red) state, and the kitchen staff enters the proximity boundary, the beacon buzzer will activate indicating a hyper-non-compliant state.

Every event will be recorded in a real-time basis. Each event will include the following data: time/date stamp; user's identification: beacon's identification; event type; battery status; badge; location of beacon; and location of dispenser.

All events recorded will be delivered to an off-site server. This data can be assessed by an Application Program Interface (API) raw data, or by web-based software (proprietary or non-proprietary).

The invention may include a Hand Hygiene and Supply/Logistics Management Program.

The Supply/Logistics Management Program is a software system designed to assist users with the real-time analysis of hand hygiene practices and the overall management of dispenser usage throughout any facility. By inputting some basic installation information, a user will be able to know who is washing, where they are washing, and when they washed; know when a kitchen staff is compliant, non-compliant, or about to be non-compliant; know when the batteries need to be replaced; know when a dispenser is not being used; be able to forecast chemical usage per dispenser, location, product, etc.; provide analytical reports of sales of the following: client name; city or state; facility location (floor, room, etc.); unit type; product type (lotion or foam); product name; and kitchen staff (chef, cook, waiter, etc.).

The invention contemplates providing the user with an accessible website by which the user can set up the system and set up interface links.

Some advantages of the system may include:

- Effective reminder system that can be used with and without badge (group vs. compliance monitoring);
- Relatively easy and low-cost installation, battery-powered, cable-free connections;
- Use of existing badge (retrofit), badges require minimal maintenance;
- Self-sustained and independent network infrastructure;
- Does not require the use of the installation facility's existing IT/Network;
- Individual server not required;
- Data analysis on and off the installed premises with remotely-accessible data;
- Proprietary supply logistics software for analyzing and archiving data; and
- Compliance monitoring using real-time data and/or multiple-prep table monitoring.

The present invention provides a kitchen sanitization compliance monitoring system for a commercial kitchen environment having food prep tables, comprising: badges wearable by persons, said badges having indicia representing a first-state indicating a sanitary compliant condition of the person, a second-state representing a cautionary state indicating the person's contact with a first food, and a third-state representing an unsanitary state indicating the person's contact with a second food after contact with, and different from, a first food, said badges also having a wireless transmitter/receiver for communicating an identification signal unique to a single badge, and the current state of the badge; food prep table antenna/beacons, each associated with a different respective food prep table, each prep table beacon having a transmitter/receiver capable of wirelessly communicating with said badges; dispenser beacons, each associated with a sanitization dispenser, and having a transmitter/receiver capable of wirelessly communicating with said badges; and wherein a badge in said first-state changes to said second-state when located in a certain proximity to raw or cooked food prep table beacon, and transmits a status change signal indicating such first-to-second-state change to the food prep table beacon with the badge identification signal; wherein a badge in said second-state changes to said third-state when located in a certain proximity to raw or cooked food prep table beacon different from the food prep table beacon which caused the badge to chancre from the first state to the second-state, and transmits a status signal indicating such second-to-third-state change to the food prep table beacon with the badge identification signal, and wherein a dispenser beacon causes a badge to change from the second-state or third-state to the first-state when the person has performed a sanitization procedure at a sanitization dispenser beacon.

The system may further include a central unit for wirelessly communication with food prep table beacons, and wherein raw or cooked food prep table beacon transmits the identification signal of the badge, and the current state of the badge, to the central unit, in response to the badge coming into a certain proximity with raw or cooked food prep table beacon.

The system may further include a central unit for wirelessly communication with dispenser beacons, and wherein a dispenser beacon transmits the identification signal of the badge, and the current state of the badge, to the central unit, in response to the badge coming into proximity with a dispenser beacon.

The badges' indicia may comprise three different color lights respectively representing the first-, second-, and third-states. The badges may include an audio beeper in response to the dispenser beacon causing a change in the badge state from a second- or third-state to a first-state.

The system may provide, in response to a badge coming in close proximity to a dispenser beacon, that the badge transmitter/receiver and the dispenser transmitter/receiver increase their respective transmitter/receiver ranges to permit communication over a wider communication-range, and wherein the respective badge and dispenser beacon lock communication to the exclusion of other badges and dispenser beacons, until communication between the badge and dispenser beacon is complete.

The system may provide, in response to a badge coming in close proximity to a prep table beacon, that the badge transmitter/receiver and the prep table beacon transmitter/receiver increase their respective transmitter/receiver ranges to permit communication over a wider communication-range, and wherein the respective badge and prep table beacon lock communication to the exclusion of other badges and prep table beacons, until communication between the badge and prep table beacon is complete.

The system may provide, that a badge in a second-state changes to the third-state if the badge leaves the certain proximity to raw or cooked food prep table and remains out of that proximity for a certain time period and re-enters that certain proximity after the certain time period.

The system may provide that a badge in the first-state changes to the second-state after a certain time period has elapsed without the badge-wearer performing a sanitization procedure.

The system may provide that a badge in the second-state changes to the third-state after a certain time period has elapsed without the badge-wearer performing a sanitization procedure.

The present invention provides a method for monitoring kitchen sanitization compliance for a commercial kitchen environment having food prep tables, comprising: providing badges wearable by persons, said badges having indicia representing a first-state indicating a sanitary compliant condition of the person, a second-state representing a cautionary state indicating the person's contact with a first food, and a third-state representing an unsanitary state indicating the person's contact with a second food after contact with, and different from, a first food, said badges also having a wireless transmitter/receiver for communicating an identification signal unique to a single badge, and the current state of the badge; providing food prep table beacons, each associated with a different respective food prep table, each prep table beacon capable of wirelessly communicating with said badges; providing dispenser beacons, each associated with a sanitization dispenser, and having a transmitter/receiver capable of wirelessly communicating with said badges; changing the state of a badge from said first-state to said second-state when located in a certain proximity to raw or cooked food prep table beacon, and transmitting a status change signal indicating such first-to-second-state change to the food prep table beacon with the badge identification signal; changing the state of a badge from said second-state to said third-state when located in a certain proximity to a raw or cooked food prep table beacon different from the food prep table beacon which caused the badge to change from the first-state to the second-state, and transmitting a status signal indicating such second-to-third-state change to the food prep table beacon with the badge identification signal; changing the status of a badge from the second-state or third-state to the first-state when the person has performed a sanitization procedure at a sanitization dispenser.

The method may include wirelessly communicating with a central unit, and wherein a raw or cooked food prep table beacon transmits the identification signal of the badge, and the current state of the badge, to the central unit, in response to the badge coming within certain proximity with a raw or cooked food prep table beacon.

The method may include wirelessly communicating with a central unit, and wherein a dispenser beacon transmits the identification signal of the badge, and the current state of the badge, to the central unit, in response to the badge coming within certain proximity with a dispenser beacon.

The method may comprise illuminating badges' indicia with three different color lights respectively representing the first-, second-, and third-states.

The method may comprise generating an audio signal by a badge in response to the dispenser beacon causing a change in the badge state from a second- or third-state to a first-state.

The method may comprise, in response to a badge coming in a certain proximity to a dispenser beacon, that the badge transmitter/receiver and the dispenser transmitter/receiver increase their respective transmitter/receiver ranges to permit communication over a wider communication-range, and wherein the respective badge and dispenser beacon lock communication to the exclusion of other badges and dispenser beacons, until communication between the badge and dispenser beacon is complete.

The method may comprise, in response to a badge coming in close proximity to a prep table beacon, that the badge transmitter/receiver and the prep table beacon transmitter/receiver increase their respective transmitter/receiver ranges to permit communication over a wider communication-range, and wherein the respective badge and prep table beacon lock communication to the exclusion of other badges and prep table beacons, until communication between the badge and prep table beacon is complete.

The method may comprise, that a badge in a second-state changes to the third-state if the badge leaves the certain proximity of the raw or cooked food prep table and remains out of that proximity for a certain time period and re-enters that certain proximity after the certain time period.

The method may comprise, that a badge in the first-state changes to the second-state after a certain time period has elapsed without the badge-wearer performing a sanitization procedure.

The method may comprise, wherein a badge in the second-state changes to the third-state after a certain time period has elapsed without the badge-wearer performing a sanitization procedure.

BRIEF DESCRIPTION OF THE DRAWINGS

FIG. 6 is a screenshot of a software program, with instructions for installing, modifying, or checking the status of the system;

FIG. 7 is a screenshot of monitoring data of dispense events of an installed system;

FIG. 8 is a screenshot of a display of menu items for setting or changing parameters of the system.

DETAILED DESCRIPTION OF THE PREFERRED EMBODIMENT

Figure 1:
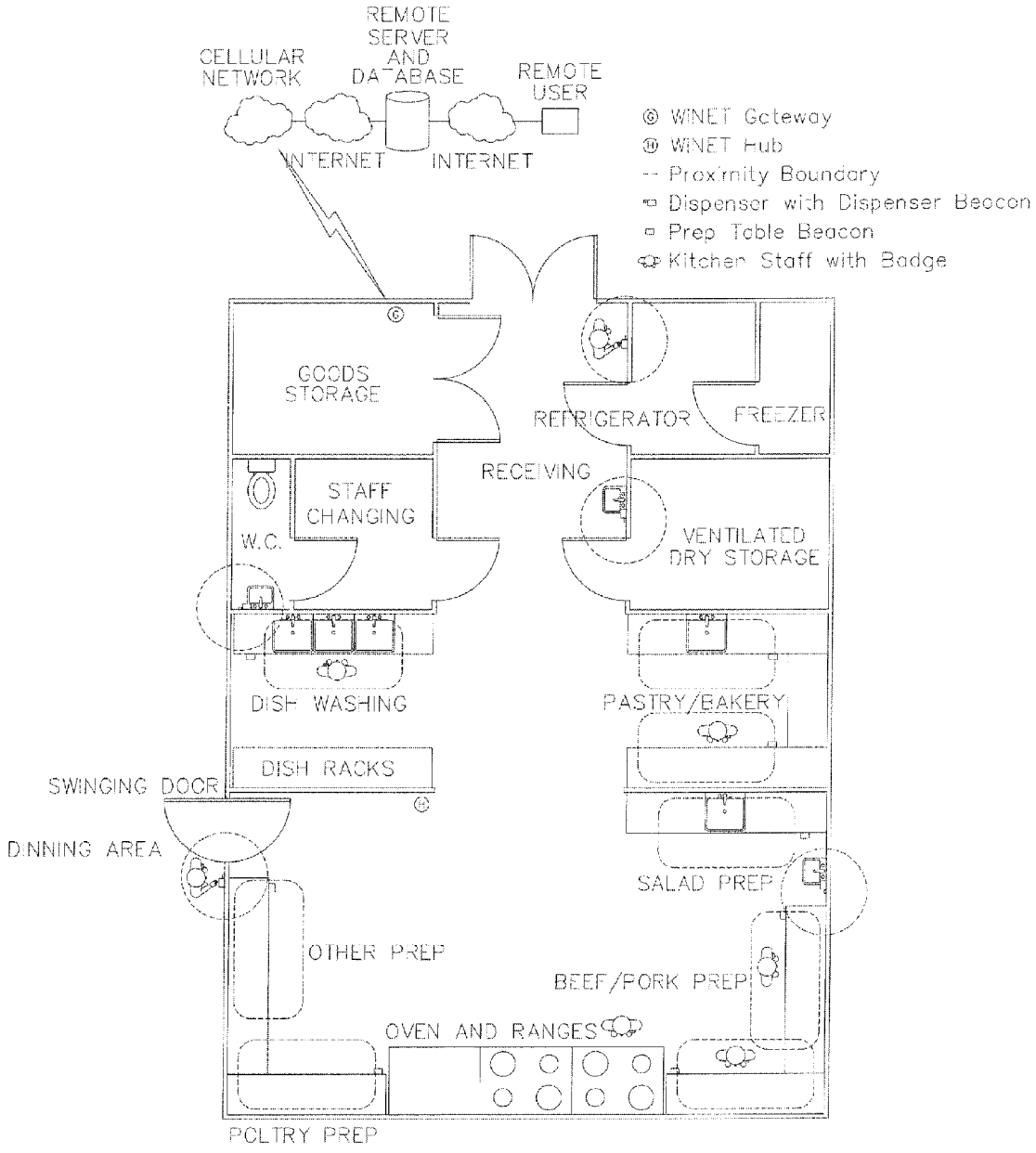
FIG. 1 is a block diagram of various components according to a preferred embodiment of the invention.

A detailed description of a preferred embodiment of the invention will be provided, but the invention is not limited to this embodiment.

The present invention provides a kitchen sanitization compliance monitoring system for a commercial kitchen environment having food prep tables, comprising: badges wearable by persons, said badges having indicia representing a first-state indicating a sanitary compliant condition of the person, a second-state representing a cautionary state indicating the person's contact with a first food, and a third-state representing an unsanitary state indicating the person's contact with a second food after contact with, and different from, a first food, said badges also having a wireless transmitter/receiver for communicating an identification signal unique to a single badge, and the current state of the badge; food prep table beacons, each associated with a different respective food prep table, each prep table beacon having a transmitter/receiver capable of wirelessly communicating with said badges; dispenser beacons, each associated with a sanitization dispenser, and having a transmitter/receiver capable of wirelessly communicating with said badges; and wherein a badge in said first-state changes to said second-state when located in a certain proximity to raw or cooked food prep table beacon, and transmits a status change signal indicating such first-to-second-state change to the food prep table beacon with the badge identification signal; wherein a badge in said second-state changes to said third-state when located in a certain proximity to a raw or cooked food prep table beacon different from the food prep table beacon which caused the badge to change from the first-state to the second-state, and transmits a status signal indicating such second-to-third-state change to the food prep table beacon with the badge identification signal, and wherein a dispenser beacon causes a badge to change from the second-state or third-state to the first-state when the person has performed a sanitization procedure at a sanitization dispenser beacon.

The system may further include a central unit for wirelessly communication with food prep table beacons, and wherein a raw or cooked food prep table beacon transmits the identification signal of the badge, and the current state of the badge, to the central unit, in response to the badge coming into a certain proximity with a raw or cooked food prep table beacon.

The system may further include a central unit for wirelessly communication with food prep table beacons, and wherein a dispenser beacon transmits the identification signal of the badge, and the current state of the badge, to the central unit, in response to the badge coming into proximity with a dispenser beacon.

The badges' indicia may comprise three different color lights respectively representing the first-, second-, and third-states. The badges may include an audio beeper in response to the dispenser beacon causing a change in the badge state from a second- or third-state to a first-state.

The system may provide, in response to a badge coming in close proximity to a dispenser beacon, that the badge transmitter/receiver and the dispenser transmitter/receiver increase their respective transmitter/receiver ranges to permit communication over a wider communication-range, and wherein the respective badge and dispenser beacon lock communication to the exclusion of other badges and dispenser beacons, until communication between the badge and dispenser beacon is complete.

The system may provide, in response to a badge coming in close proximity to a prep table beacon, that the badge transmitter/receiver and the prep table beacon transmitter/receiver increase their respective transmitter/receiver ranges to permit communication over a wider communication-range, and wherein the respective badge and prep table beacon lock communication to the exclusion of other badges and prep table beacons, until communication between the badge and prep table beacon is complete.

The system may provide, that a badge in a second-state changes to the third-state if the badge leaves the certain proximity to a raw or cooked food prep table and remains out of that proximity for a certain time period and re-enters that certain proximity after the certain time period.

The system may provide that a badge in the first-state changes to the second-state after a certain time period has elapsed without the badge-wearer performing a sanitization procedure.

The system may provide that a badge in the second-state changes to the third-state after a certain time period has elapsed without the badge-wearer performing a sanitization procedure.

The present invention provides a method for monitoring kitchen sanitization compliance for a commercial kitchen environment having food prep tables, comprising: providing badges wearable by persons, said badges having indicia representing a first-state indicating a sanitary compliant condition of the person, a second-state representing a cautionary state indicating the person's contact with a first food, and a third-state representing an unsanitary state indicating the person's contact with a second food after contact with, and different from, a first food, said badges also having a wireless transmitter/receiver for communicating an identification signal unique to a single badge, and the current state of the badge; providing food prep table beacons, each associated with a different respective food prep table, each prep table beacon capable of wirelessly communicating with said badges; providing dispenser beacons, each associated with a sanitization dispenser, and having a transmitter/receiver capable of wirelessly communicating with said badges; changing the state of a badge from said first-state to said second-state when located in a certain proximity to a raw or cooked food prep table beacon, and transmitting a status change signal indicating such first-to-second-state change to the food prep table beacon with the badge identification signal; changing the state of a badge from said second-state to said third-state when located in a certain proximity to a raw or cooked food prep table beacon different from the food prep table beacon which caused the badge to change from the first-state to the second-state, and transmitting a status signal indicating such second-to-third-state change to the food prep table beacon with the badge identification signal; changing the status of a badge from the second-state or third-state to the first-state when the person has performed a sanitization procedure at a sanitization dispenser.

The method may include wirelessly communicating with a central unit, and wherein a raw or cooked food prep table beacon transmits the identification signal of the badge, and the current state of the badge, to the central unit, in response to the badge coming within certain proximity with raw or cooked food prep table beacon.

The method may include wirelessly communicating with a central unit, and wherein a dispenser beacon transmits the identification signal of the badge, and the current state of the badge, to the central unit, in response to the badge coming within certain proximity with a dispenser beacon.

The method may comprise illuminating badges' indicia with three different color lights respectively representing the first-, second-, and third-states.

The method may comprise generating an audio signal by a badge in response to the dispenser beacon causing a change in the badge state from a second- or third-state to a first-state.

The method may comprise, in response to a badge coming in a certain proximity to a dispenser beacon, that the badge transmitter/receiver and the dispenser transmitter/receiver increase their respective transmitter/receiver ranges to permit communication over a wider communication-range, and wherein the respective badge and dispenser beacon lock communication to the exclusion of other badges and dispenser beacons, until communication between the badge and dispenser beacon is complete.

The method may comprise, in response to a badge coming in close proximity to a prep table beacon, that the badge transmitter/receiver and the prep table beacon transmitter/receiver increase their respective transmitter/receiver ranges to permit communication over a wider communication-range, and wherein the respective badge and prep table beacon lock communication to the exclusion of other badges and prep table beacons, until communication between the badge and prep table beacon is complete.

The method may comprise, that a badge in a second-state changes to the third-state if the badge leaves the certain proximity to a raw or cooked food prep table and remains out of that proximity for a certain time period and re-enters that certain proximity after the certain time period.

The method may comprise, that a badge in the first-state changes to the second-state after a certain time period has elapsed without the badge-wearer performing a sanitization procedure.

The method may comprise, wherein a badge in the second-state changes to the third-state after a certain time period has elapsed without the badge-wearer performing a sanitization procedure.

As shown in FIG. 1, the system 10 will consist of wireless kitchen staff badges 12, wireless dispenser beacons 14 associated with sanitization dispensers 14*a*, and wireless food prep table beacons 16 associated with prep tables 16*a*. The food prep table beacons 14 could be floor mats or other presence and identity detection devices to detect the presence and identity of a person. The badges 12 and beacons 14, 16, will communicate via embedded 125 kHz low frequency magnetic coupled (LFMC) radio transceivers. All devices will be battery powered. Event telemetry will be conveyed by the beacons to a central unit CU with an offsite event database via a separate 433 MHz wireless network (WiNET). The network transceivers will be embedded within the dispenser and food prep table beacons.

Figure 1A:
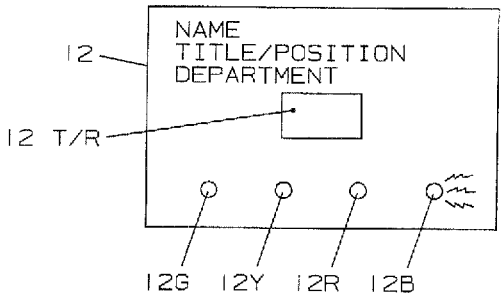
FIG. 1A shows a badge.

The kitchen staff badge 12 will maintain and store the current hygienic state of its user. The user's hygienic state will be made visible to the user, and anyone able to see the user's badge 16, via LEDs located on the badges 12. There are three states supported by the badge 12, a first state of compliant (green LED), a second state of cautionary (yellow LED), and third state of noncompliant (red LED). FIG. 1A shows a badge 12 with green LED 12G, yellow LED 12Y, and red LED 12R.

The badge also has a place for the wearer's name and/or other indicia such as title or position (chef, cook, waiter, etc.) and/or department (kitchen, maintenance, food service, etc.), which further identify the badge wearer to foods and other kitchen personnel. Electronic data representing this information may also be transmitted between the badge, prep table beacons and dispenser beacons. The badge 12 also has a beeper or acoustic transducer 12B, and a transmitter/receiver 12T/R, with appropriate electronics. The beeper 12B may transmit different sounds depending on the state of the badge, and the title or department, etc., as well as the number of recent or total times the wearer has experienced a "red" status. The different sound may be a difference in frequency, duration, warbling, etc. For wearers who frequently get a "red" status, for whom the sound may be distinctive, the kitchen staff or other persons will know that the wearer is a frequent violator and be extra cautious about contact with such wearer.

The prep table beacon also has a transmitter/receiver 16 T/R. The dispenser beacon also has a transmitter/receiver 14T/R. The badge, prep table beacon and dispenser beacon have appropriate electronic circuitry, such as microprocessors or controllers, with memory and control programs, to perform the functions described herein.

The user's badge 12 is set to the compliant state when a sanitation event occurs. A sanitation event will occur when the user activates a dispenser 14*a* to dispense soap or sanitizer on their hands. The user's badge 12 is set to the noncompliant state when an unsanitary event occurs. An unsanitary event will occur when the user has contact with one food and then has contact with a different food without a sanitation event occurring in-between. The user's badge 12 is set to the cautionary state when they come in contact with raw or cooked food after having a prior sanitation event. This is not a noncompliant state, but, instead warns the user that a sanitary event needs to occur. If a sanitary event does not occur within 5 minutes, for example, after leaving raw or cooked food, the user's badge will set itself into the noncompliant state and thus generate an unsanitary event.

Figure 2:
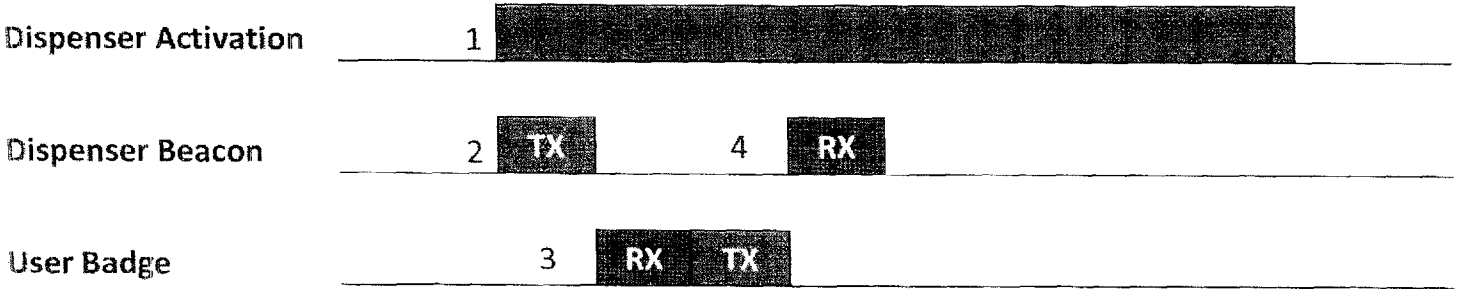
FIGS. 2 & 2A are timing diagrams showing communication between a dispenser and a user badge.

The dispenser beacon 14 is physically attached to a dispenser 14*a* via a cable that will provide the beacon with power, if the dispenser is battery-operated, and a signal indicating when the dispenser has been activated. As shown in FIG. 2, when a user activates the dispenser 14*a*, the beacon will detect the activation and send a polling message containing its unique ID and having an effective range, or proximity radius of 24" to 32", for example, (as shown by the dotted circles in FIG. 1). The user's badge, being within the aforementioned radius, will quickly reply by sending the dispenser beacon its identification number (ID) and current hygienic state. After the user's badge has sent its reply, it will set itself into the compliant state, store the unique ID of the dispenser beacon and create an audible beep to inform the user that the transaction is complete. When the dispenser activation is complete, the dispenser beacon will time and date stamp the sanitary event and send it along with the badge's ID and prior hygienic state to an offsite database via the WiNET wireless network.

Figure 3:
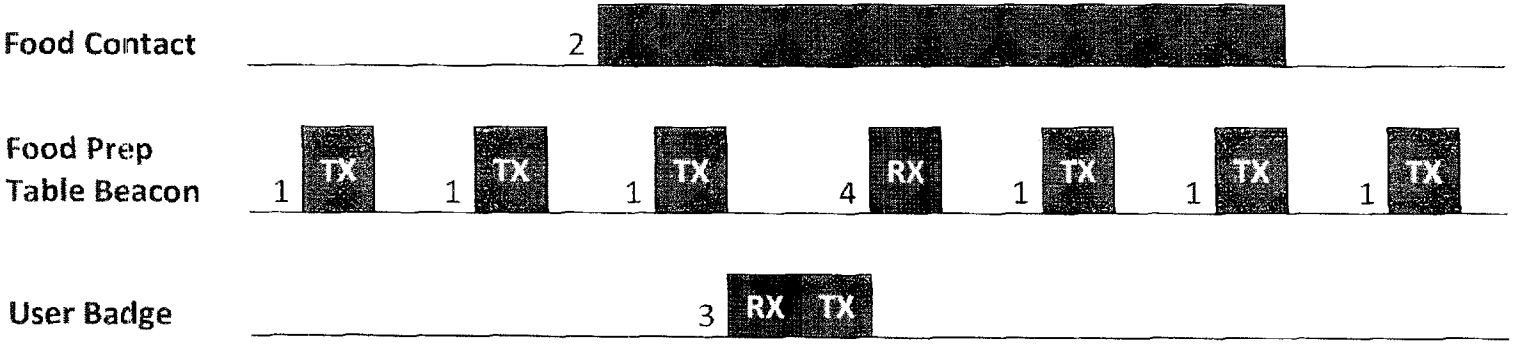
FIGS. 3& 3A are timing diagrams showing communication between a prep table beacon and a user badge.

The food prep table beacon will be physically attached to the food prep table and have an antenna that uses an insulated conductor to form a loop around the perimeter of the prep table or b) uses a coil to inductively couple to the prep table's metal frame without being in physical contact with the prep table's metal frame. As shown in FIG. 3, the prep table beacon will send a polling message containing its unique ID once every 1 to 5 seconds, for example. If a user's badge is within about 24" of the prep table's perimeter (as shown by the dotted lines in FIG. 1), it will receive the polling message, store the prep table beacon's ID and wait a random length of time to reply with its ID, hygienic state and the ID of the last dispenser used. Waiting a random length of time before replying to the prep table beacon will reduce message collisions with any other badges approaching the prep table at the same time. When the prep table beacon 16 receives the user's badge ID, state and the ID of the last dispenser used, the transaction will be complete.

The prep table beacon will continue to broadcast a polling message at regular intervals. The user's badge will receive the polling message and compare the received prep table beacon's ID to the stored prep table beacon ID. If they match, the user's badge will not reply. This will give other user's badges a chance to communicate and extend the badge's battery life.

When the transaction between the user's badge and the prep table beacon is complete, the prep table beacon will time and date stamp the food contact event and send it along with the badge's ID, prior hygienic state and current hygienic state to the offsite database via the WiNET wireless network.

If other user badges are within range of the prep table beacon, they will each wait for the next polling message from the beacon and reply after a random length of time. The first user badge to reply will transact with the prep table beacon. All other user badges will wait for the next polling message after the current transaction is complete. This will continue until all user badges, within range of the prep table beacon, have transacted.

A more detailed description of the operation of the above-described system follows, and will describe the general logic of how a dispenser, a kitchen staff badge and a raw or cooked food prep table beacon will interact to provide a system of kitchen staff hand hygiene compliance monitoring in a commercial kitchen setting or similar facility. The system's logic will be illustrated using examples of successful and unsuccessful interactions.

Sanitary Kitchen staff and Single-Food Interaction Example

1. A kitchen staff member activates a sanitization dispenser.
2. The dispenser will identify itself to the badge and the badge will set itself to the green state (sanitary state). An audible beep, from the badge, informs the kitchen staff member of the state change and the badge's green LED will blink about once per second. This event will be sent to the WiNET remote server via the dispenser beacon as a dispenser activation event with the dispenser and badge address, time and date. The badge will remain in the green state until raw or cooked food interaction occurs.
3. The kitchen staff member approaches a raw or cooked food prep table.
4. When within approximately 24" of the food prep table, the badge will detect the beacon associated with the prep table.
5. The prep table beacon will identify itself to the badge. The badge will tell the prep table beacon that it is in the green state then set itself to the yellow state (cautionary state) to indicate food contact. An audible beep, from the badge, informs the kitchen staff member of the state change and the badge's yellow LED will blink about once per second. This event will be sent to the WiNET remote server via the prep table beacon as a sanitary/compliant food interaction event along with the beacon and badge address, time and date.

The yellow state will inform the kitchen staff member, and anyone who sees the kitchen staff member's badge, that the kitchen staff member has been in recent contact with raw or cooked food and is in an unsanitary state. A timeout can be implemented that will set the badge to a red state (hygiene compliance violation state) if the badge remains in the yellow state too long (possibly 5 or 10 minutes, for example).

Unsanitary Kitchen staff and Single-Food Interaction Example

1. Assume that a kitchen staff member's badge is currently in the yellow state (cautionary state) due to recent interaction with raw or cooked food.
2. The kitchen staff member approaches a raw or cooked food prep table.
3. When within approximately 24" of the food prep table, the badge will detect the prep table's beacon.
4. The prep table beacon will identify itself to the badge. The badge is in the yellow state, and the last interaction was with a different food (prep table beacon), so the badge will immediately set itself to the red state (hygiene compliance violation state). An audible beep from the badge, informs the kitchen staff member of the state change, and the badge's red LED will blink about once-per-second. The badge will also produce an audible alarm beep once-per-second, while in the red state. This event will be sent to the WiNET remote server via the prep table beacon, as an unsanitary/noncompliant food interaction event along with the prep table beacon address, badge address, and time and date.
5. The prep table beacon will produce an audible alarm for a pre-determined period, 30 seconds, for example, after an unsanitary/non-compliant food interaction occurs. The badge will remain in the red state until reset to the green state by activating a dispenser.

The red state will inform the kitchen staff member and anyone who sees or hears the kitchen staff member's badge, that the kitchen staff member has committed a hygiene compliance violation and needs to activate a dispenser immediately.

Unsanitary/non-compliant food interaction events can be monitored in nearly real-time by other staff members via web based software connected to the WiNET offsite database. This allows for the execution of immediate corrective action.

Multi-Food Interaction Example

1. Assume that a kitchen staff member's badge is currently in the green state (sanitary state).
2. The kitchen staff member approaches food type one's prep table.
3. When within approximately 24" of food type one's prep table, the badge will detect the prep table's beacon.
4. The prep table beacon will identify itself to the badge. The badge will tell the prep table beacon that it is in the green state then set itself to the yellow state (cautionary state). An audible beep from the badge informs the kitchen staff member of the state change, and the badge's yellow LED will blink about once-per-second. This event will be sent to the WiNET remote server via the prep table beacon as a sanitary/compliant food interaction event along with the prep table beacon address, badge address, and time and date.
5. When the kitchen staff member's interaction with food type one is complete, the kitchen staff member will leave the prep table side of food type one. The badge will remain in the yellow state.
6. The kitchen staff approaches food type two's prep table. When within approximately 24" of food type two's prep table, the badge will detect the prep table's beacon.
7. The prep table beacon will identify itself to the badge. The badge is in the yellow state, and the last interaction was with a different type of food (prep table beacon), so the badge will immediately set itself to the red state (hygiene compliance violation state). An audible beep from the badge, informs the kitchen staff member of the state change, and the badge's red LED will blink about once-per-second. The badge will also produce an audible alarm beep once-per-second while in the red state. This event will be sent to the WiNET remote server via the prep table beacon, as an unsanitary/noncompliant food interaction event along with the beacon address, badge address, and time and date.
8. When the kitchen staff member's interaction with food type two is complete, the kitchen staff member will leave the prep table side of food type two. The badge will remain in the red state until reset to the green state by activating a dispenser.
9. The kitchen staff member ignores the badge's red state, and approaches food type three's prep table. When within approximately 24" of food type three's prep table, the badge will detect the prep table's beacon.
10. The prep table beacon will identify itself to the badge. The badge is in the red state (hygiene compliance violation state), so the prep table beacon will immediately sound its audible alarm, and the badge will remain in the red state. The badge's red LED will continue to blink about once-per-second. The badge will also continue to produce an audible alarm beep once per second while in the red state. This event will be sent to the WiNET remote server via the prep table beacon as an unsanitary/noncompliant food interaction event along with the beacon address, badge address, and time and date.

The badge will store the address of the last prep table beacon it interacted with. The prep table beacon will broadcast its address at pre-determined intervals, (1 to 5 seconds for example). The badge will acknowledge the first broadcast it hears and store the address in temporary memory. Upon receiving subsequent prep table beacon broadcast, the badge will compare the prep table beacon's address to the one stored in memory. If the addresses match, the badge will ignore the broadcast. If the addresses don't match, the badge will know it is interacting with a different prep table beacon, and will react based on its current state. If in the yellow state, go to the red state. If in the red state, it will stay in the red state.

Unsanitary/non-compliant food interaction events can be monitored in nearly real-time by other staff members via web-based software connected to the WiNET offsite database. This allows for the execution of immediate corrective action.

Activating a dispenser will cause the badge to reset itself to the green state and clear the stored prep table beacon's address. While in the green state, interaction with any prep table beacon will cause the badge to go from the green state to the yellow state, and that prep table beacon's address will be stored.

Figure 2A:
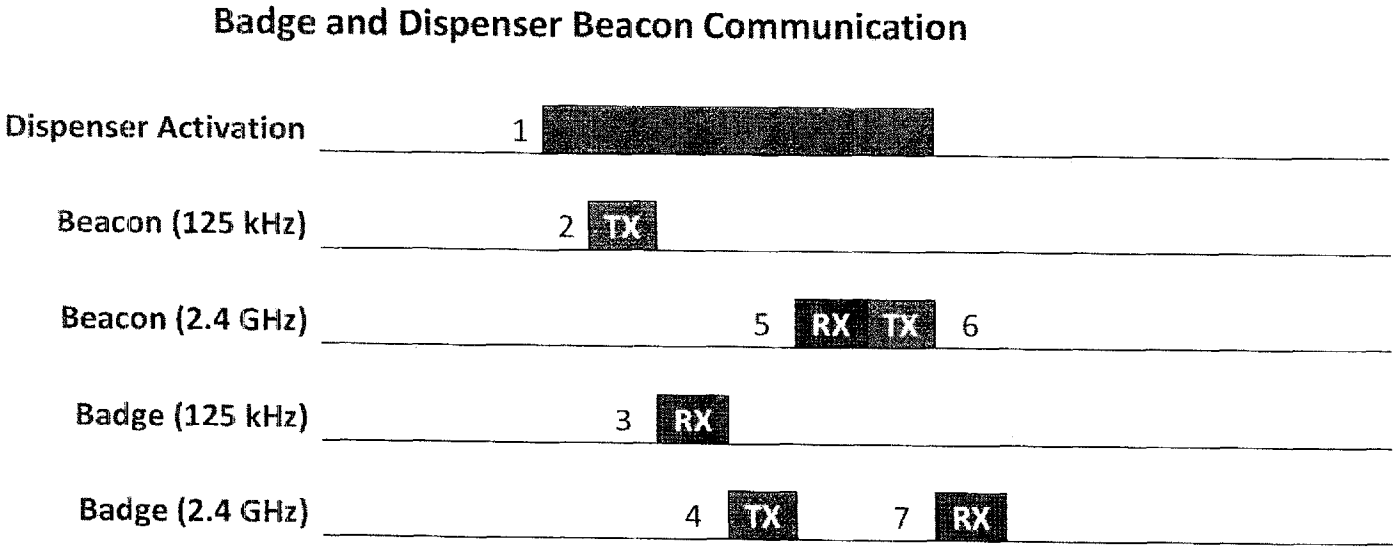
Figure 3A:
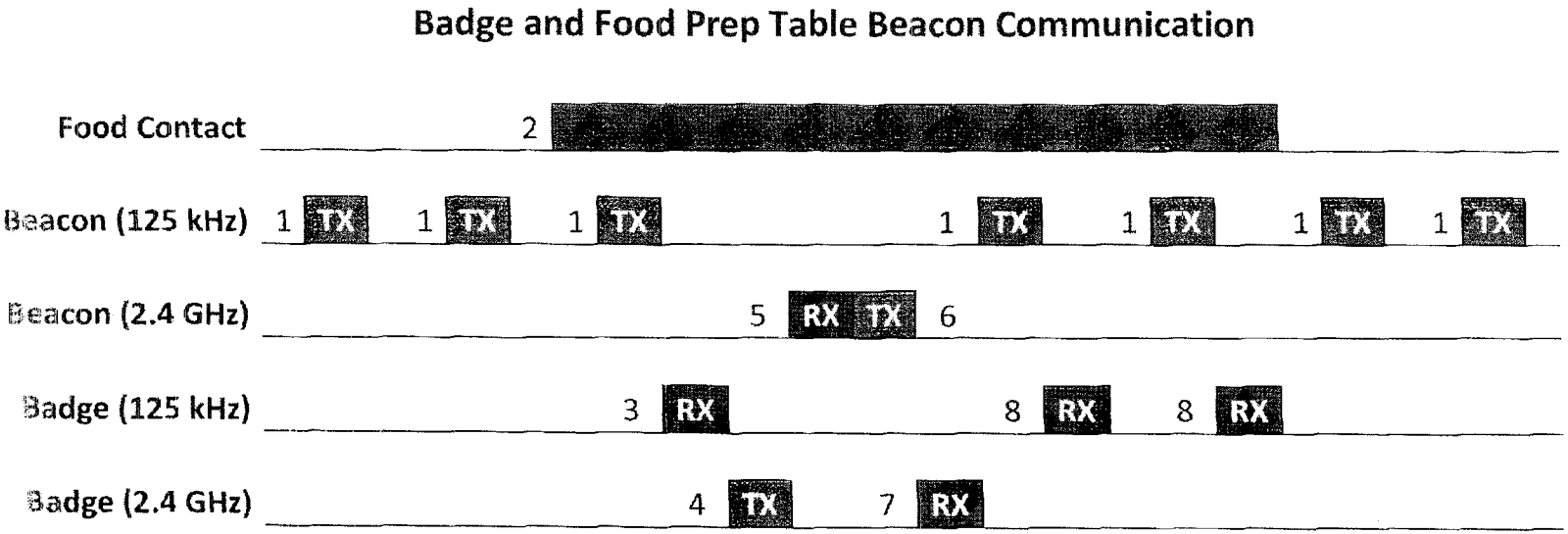
Figure 4:
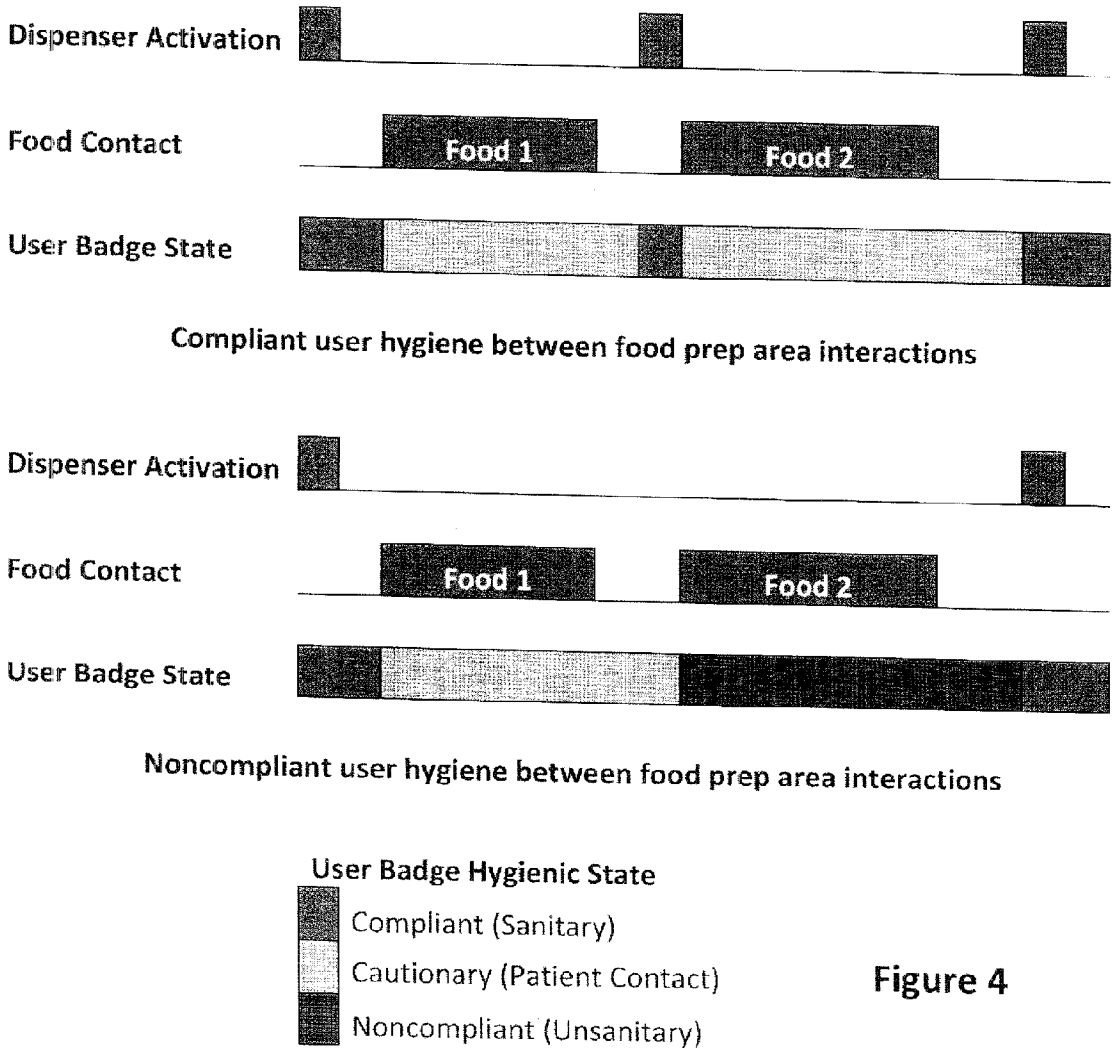
FIG. 4 is a diagram showing examples of user badge hygienic state and food interaction.

The badge and beacons (both prep table beacons and dispenser beacons) use a wireless medium to communicate with each other. As shown in FIGS. 2A and 3A, the wireless communications, between badges and beacons, may be separated into two distinct frequency ranges, low frequency (LF) and high frequency (HF).

The LF range is used primarily to "wake-up" the badge when it comes within close proximity of a beacon. The purpose of "waking-up" the badge is so that the micro controller (μC) (or CPU) can remain in a low power sleep state until needed. This will extend the life of the badge's battery. The badge is a mobile device that is worn by a user and therefore there is an advantage to having it as light weight and compact as possible. To this end, the battery powering the badge must be small. The current embodiment of the badge design may use a CR2032 3V lithium battery with a current capacity of only 200 mAh to 250 mAh.

The LF receiver may draw as little as between 2 μA and 4 μA and is able to detect a 125 kHz signal transmitted from a beacon. When a signal is detected, the receiver activates an input on the badge's μC which was preprogrammed to cause the μC to "wake-up" from a low power sleep state. Once awake, the μC then communicates with the receiver to read the beacon's address (or ID number) that is modulated on the 125 kHz signal.

A major advantage of using a LF signal is that its wavelength (λ) is very long. For 125 kHz, the wavelength is about 2,400 m. When the antenna/beacon/beacon's length (or circumference) is short relative to the signal's wavelength, the electromagnetic field radiated by the antenna/beacon/beacon is dominated by the magnetic field at close range. A magnetic field's power, as it propagates through space, will dissipate at a rate of $1/r^6$ where r=distance. A HF electromagnetic field such as RF will dissipate at a rate of $1/r^2$ and thus propagates farther through space with a much slower dissipation rate. Therefore, the rapid dissipation of a magnetic field makes it well suited for creating a distinct and predictable proximity boundary around a raw or cooked food prep table or dispenser that is similar to a wall. The boundary range can be adjusted by increasing or decreasing the current flowing through their respective LF loop antenna.

Once a badge has crossed within a prep table's proximity boundary, it will detect the prep table beacon's transmitted signal, wake-up and then read the prep table beacon's address that is modulated on the signal. Now, the badge needs to send the beacon its address and current sanitary state. It would be possible for the badge to use LF to transmit this information but there are two reasons not to. First, a LF antenna needs to be designed to either transmit (series LCR tuned circuit) or receive (parallel LCR tuned circuit) to maximize efficiency. This would require two antennas for both the badge and the beacon which would add extra weight, size and cost to the badge. Second, the LF magnetic field has limited range. This is good for proximity detection but it isn't good for data communication. The badge's user may wander away from the food prep table's proximity boundary before the full exchange of data between the badge and beacon is complete, especially if the user is standing near the proximity boundary. The problem is even more likely when using a dispenser as the user will activate the dispenser and then immediately walk away.

To increase reliability of data communication beyond initial proximity detection, the badge will switch to HF to complete the transaction with a beacon. The HF signal has a much longer range allowing the badge to communicate with a beacon even if the user is 10 or 20 feet away from the beacon. The high frequency signal also has a short wavelength so a bidirectional antenna can be etch into the copper of the circuit board with no additional cost or weight added to the badge or beacon. In the current embodiment of the badge and beacon designs, the HF signal is at a frequency of 2.4 GHz.

In addition or in lieu of the badge having three different colored LEDs to indicate the sanitary state of its wearer, the badge can receive the identity of the prep table, and thus the food type or name of the food presently occupying the prep table. The badge can display the identity of the prep table, the number or type of food, and/or the identity by name of the food. Other kitchen staff members, upon seeing the badge, will be able to see this information on the badge and be assured that the badge user is sanitary for that food. If the user's badge had a green state and entered the prep table region for a certain food, the badge could display the name of that food, the identity of the prep table and/or food number/type. If the badge started out yellow (because of contact with a different food or prep area) or red, the badge would not change to the present food's name. Other kitchen staff members would thus not see the food's name on the user's badge, and could then alert the user to sanitize. Because the user would know that other kitchen staff members have an easy way to detect whether the user has been sanitized for that food, the user is more apt to comply with the sanitization protocols.

Figure 5:
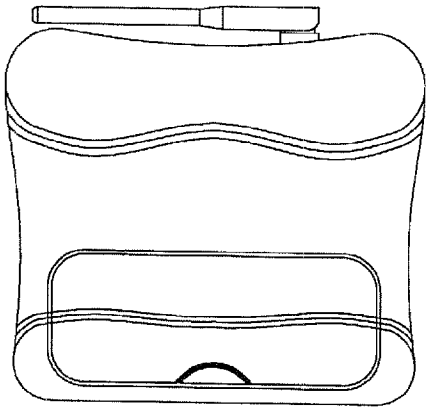
FIG. 5 is a view of a prep table beacon.
Figure 9:
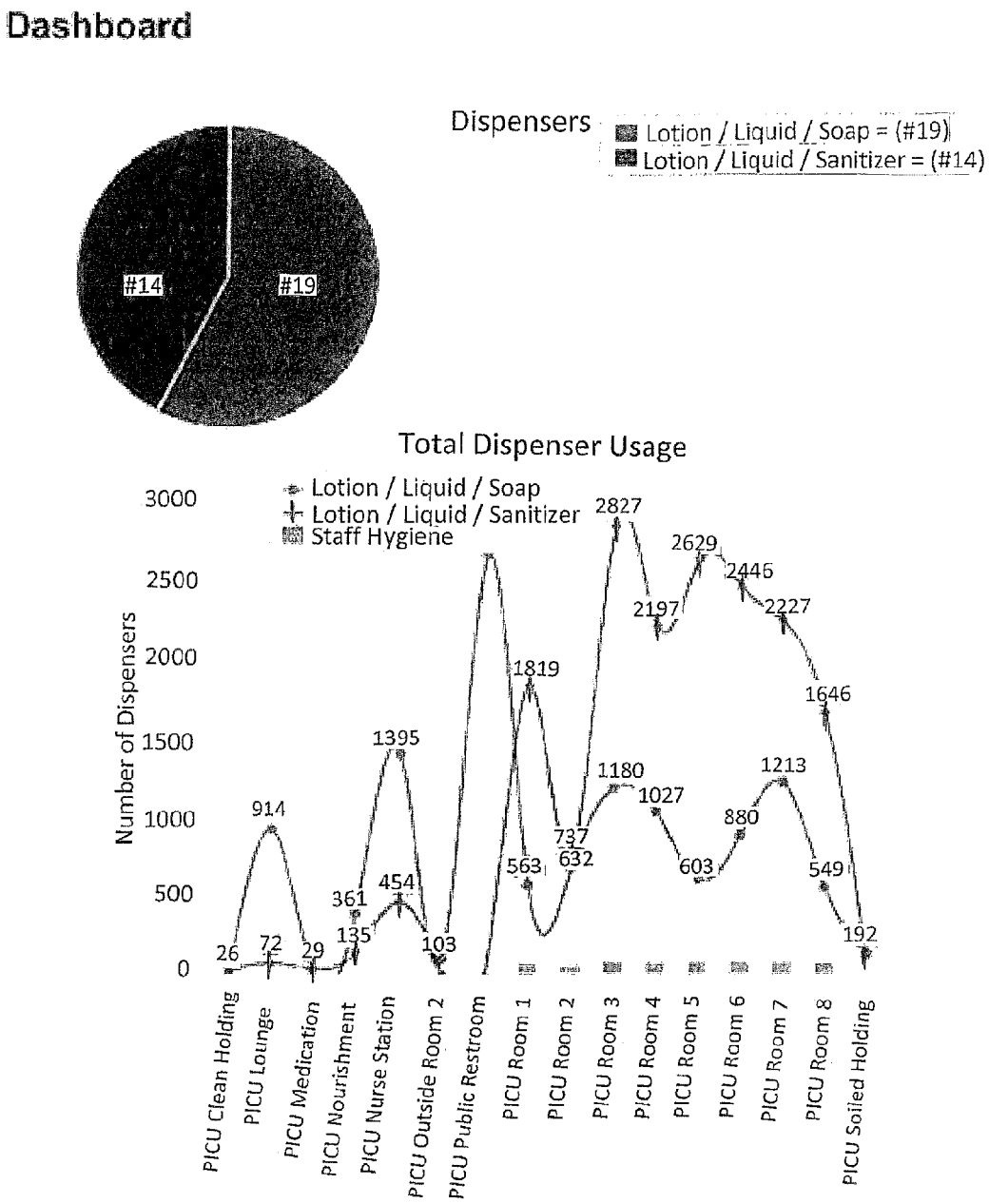
FIG. 9 is a display of the dashboard of the system, showing soap and sanitizer used at various dispenser locations.

FIG. 5 shows a view of a prep table beacon, which has a body enclosing transmitter/receiver and appropriate electronics, as well as an internal or external antenna. The dispenser beacon may look the same, and may be larger or smaller.

The invention provides additional ways of minimizing risk of contamination of foods. If a waiter, cook or chef wearing a badge is within the prep table proximity but crosses over the proximity boundary and leaves the prep table proximity zone for a certain period of time, for example, 5 seconds, an assumption is made that there is a reasonable likelihood that the waiter, cook or chef has contacted a source of contamination (such as a restroom or contaminated disposal area) which could pose a contamination risk to raw or cooked food within that prep table proximity region. The badge state will then change from the basic yellow cautionary state to an elevated yellow cautionary state, still displaying yellow. In this elevated yellow cautionary state, if the waiter, cook or chef returns to the same prep table proximity region after that period of time (without sanitizing), the badge state will change to red, indicating a contamination risk to that food in the prep table.

If the waiter, cook or chef wearing a badge leaves the prep table proximity zone, but returns within the certain period of time (e.g., 5 seconds), it is assumed that the waiter, cook or chef has not been exposed to a source of contamination, and the badge state does not change.

The mechanism to detect whether the waiter, cook or chef has traveled and remained outside the prep table proximity zone is the prep table beacon which transmits a periodic prep table beacon signal every second or so. The badge, if within the proximity zone, will receive the periodic prep table beacon signal, and will transmit a signal back indicating that the badge is within the zone. However, when the badge travels outside the zone, the badge no longer receives the periodic prep table beacon signal, and commences a time count. If, within the certain maximum safety time period (e.g., 5 seconds) the badge returns to within the prep table proximity zone and again receives the periodic prep table beacon signal, the time count is re-set to zero. But, if the time count reaches the certain maximum safety time period (e.g., 5 seconds), with the badge outside the prep table proximity zone, the badge state changes to the elevated, yellow cautionary state. In the same manner as described above, in this elevated, yellow cautionary state, if the kitchen staff member returns to the same prep table proximity region (without sanitizing), the badge state will change to red, indicating a contamination risk to that food.

In another feature according to the invention, a badge will change state after the lapse of a certain inactivity time (a time within which a waiter, cook or chef has neither been detected within a prep table proximity zone, or has undergone sanitization). If the badge was in the green state, and a certain inactivity time of 60 minutes, for example, has elapsed, it is reasonable to assume that the waiter, cook or chef has had some interaction with a source of contamination (such as a restroom or contaminated disposal area), and the badge will change to yellow. If the badge is in the yellow state for whatever reason, and a certain inactivity time of 15 minutes, for example, has elapsed without sanitization (which would re-set the badge to green), the badge state will change to red.

The reason for the shorter inactivity time of 15 minutes to trigger a yellow-to-red change, is based on the assumption that a waiter, cook or chef all ready in the yellow state, signifying that the waiter, cook or chef has already had an exposure to a prep table food, poses more of a contamination-risk to prep table foods (as well as other foods, waiters, cooks, chefs, personnel, or other items or regions). Of course, the 60-minute and 15-minute inactivity time periods can be changed, and can even be equal. The time periods can be selected based on the risk (perceived or actual) based on the environment, and even on a personal badge level, based on the particular waiter, cook or chef, given his/her history of compliance and risk. Thus, different waiters, cooks or chefs can have different time periods, depending on their history of compliance and risk.

The invention also provides a means of controlling or monitoring risk of contamination of raw or cooked food from a waiter, cook or chef by monitoring whether a waiter, cook or chef has one or more risk-control items, such as gloves or the like.

In one example, any particular food and/or food prep table region can be selectively defined to require waiters, cooks or chefs coming in contact with the food/prep table to have one or more of these risk-control equipment items. The prep table beacon associated with that food can have means to selectively activate what risk-control items are required for that food and/or food prep table region. When a waiter, cook or chef comes into the prep table proximity zone, the prep table beacon can detect whether the waiter, cook or chef has the items required, by the items themselves having similar badges or other identification/communication devices associated with these items. For example, if the waiter, cook or chef is required to wear gloves, but does not have gloves, the prep table beacon will detect that the gloves are missing because it failed to receive an acknowledgement signal for the gloves when the waiter, cook or chef entered the prep table proximity zone. The prep table beacon can then transmit a violation signal to the waiter, cook or chef's badge (or separate badge), which will cause the badge to store and indicate a failure to comply, and the existence of a risk-situation. Tracking and detection of the risk-control items required by a waiter, cook or chef can be done within the existing prep table beacon and waiter, cook or chef badge discussed above, or by different beacons and badges.

The invention may be used with equipment other than, or in addition to, prep tables, including any piece of equipment associated with food preparation, such as cutlery, temperature probes or the like.

Instead of, or in addition to, monitoring raw or cooked food prep tables or pieces of equipment associated with raw or cooked food, the monitored equipment may be a place or region that poses a risk of contamination, such as a toilet, refuse container, urinal, or the like.

Instead of detecting when a person comes into a contaminated area or region, one can detect when a person leaves a sanitary area or region, such as a handwash area, a sanitization area, food preparation area, or service area.

The state of the badge can be a state indicating an (1) unsanitary state or condition; (2) a sanitary state; or (3) either an unsanitary or cautionary state.

The signal transmitted which indicates the state of the badge, includes transmitting which transition or change a badge is undergoing, e.g., red-to-green, green-to-yellow, etc.

The signal transmitted can indicate the state of the badge and badge identity, either by data within the signal, or by the manner in which the signal is transmitted, such as frequency, modulation technique, or signal conditioning.

The monitoring system of the invention can also be used to monitor when equipment, items, or areas of a kitchen, have been sanitized. The badge can be attached to a sanitizer or disinfectant, such as a bleach product. The equipment, items, or areas of a kitchen can be equipped with an associated beacon. The beacon can detect when the badge, and thus, sanitizer or disinfectant, are within a certain proximity and have thus sanitized or disinfected the area. The length of time that the badge is within the certain proximity can be detected and used to determine whether a proper sanitization or disinfecting has taken place according to a protocol or procedure. In a variation, the equipment, items, or areas, could be equipped with a badge, and the sanitizer or disinfectant could be engaged with a beacon. Even without badges, the system can detect when a dispenser device has dispensed products, thereby indicating when equipment, item, part, or area of a kitchen, has been sanitized.

Although one preferred embodiment has been described, the invention is not limited to this embodiment. Variations may be made within the scope of the invention, and the invention is defined only by way of the following claims.

What is claimed is:

1. A kitchen sanitization compliance monitoring system for a commercial kitchen environment having food prep tables, comprising: badges wearable by persons, said badges having indicia representing a first-state indicating a sanitary compliant condition of the person, a second-state representing a cautionary state indicating the person's contact with a first food prep table or first food prep area, and a third-state representing an unsanitary state indicating the person's contact with a second food prep table or second food prep area after contact with, and different from, a first food prep table or first food prep area, each one of said badges also having a wireless transmitter/receiver for communicating an identification signal unique to a single badge, and the current state of the badge; food prep table beacons, each associated with a different respective food prep table or area, each prep table beacon having a transmitter/receiver capable of wirelessly communicating with said badges;

dispenser beacons, each associated with a sanitization dispenser, and each dispenser beacon having a transmitter/receiver capable of wirelessly communicating with said badges; and wherein each of the said badges in said first-state changes to said second-state when located in a certain proximity to a food prep table beacon, and transmits a status change signal indicating such first-to-second-state change to the food prep table beacon with the badge identification signal;

wherein each of the said badges in said second-state changes to said third-state when located in a certain proximity to a food prep table beacon different from the food prep table beacon which caused the badge to change from the first-state to the second-state, and transmits a status signal indicating such second-to-third-state change to the food prep table beacon wherein a dispenser beacon causes a badge to change from the second-state or third-state to the first-state when the person has performed a sanitization procedure at the sanitization dispenser beacon.

2. The system according to claim 1, further including a central unit for wirelessly communication with food prep table beacons, and wherein the food prep table beacon transmits the identification signal of the badge, and the current state of the badge, to the central unit, in response to the badge coming into a certain proximity with a the food prep table beacon.

3. The system according to claim 1, further including a central unit for wirelessly communication with dispenser beacons, and wherein the dispenser beacon transmits the identification signal of the badge, and the current state of the badge, to the central unit, in response to the badge coming into proximity with the dispenser beacon.

4. The system of claim 1, wherein the badges' indicia comprise three different color lights respectively representing the first-, second-, and third-states.

5. The system of claim 1, wherein the badges include an audio beeper in response to the dispenser beacon causing a change in the badge state from the second- or third-state to a the first-state.

6. The system of claim 1, wherein, in response to a badge coming in close proximity to a one of the dispenser beacons, the badge transmitter/receiver and the dispenser transmitter/receiver increase their respective transmitter/receiver ranges to permit communication over a wider communication-range, and wherein the respective badge and dispenser beacon lock communication to the exclusion of other badges and dispenser beacons, until communication between the badge and dispenser beacon is complete.

7. The system of claim 1, wherein, in response to any one of the badges coming in close proximity to any one of the prep table beacons, the badge transmitter/receiver and the prep table beacon transmitter/receiver increase their respective transmitter/receiver ranges to permit communication over a wider communication-range, and wherein the respective badge and prep table beacon lock communication to the exclusion of other badges and prep table beacons, until communication between the badge and prep table beacon is complete.

8. The system of claim 1, wherein a badge in the second-state changes to the third-state if the badge leaves the certain proximity to a food prep table and remains out of that proximity for a certain time period and re-enters that certain proximity after the certain time period.

9. The system of claim 1, wherein any one of the badges in the first-state changes to the second-state after a certain time period has elapsed without the badge-wearer performing a the sanitization procedure.

10. The system of claim 1, wherein any one of the badges in the second-state changes to the third-state after a certain time period has elapsed without the badge-wearer performing a the sanitization procedure.

11. A method for monitoring sanitization compliance for a commercial kitchen environment having food prep tables, comprising: providing badges wearable by persons, said badges having indicia representing a first-state indicating a sanitary compliant condition of the person, a second-state representing a cautionary state indicating the person's contact with a first food, and a third-state representing an unsanitary state indicating the person's contact with a second food after contact with, and different from, a first food, each one of said badges also having a wireless transmitter/receiver for communicating an identification signal unique to a single badge, and the current state of the badge; providing food prep table beacons, each associated with a different respective food prep table, each prep table beacon capable of wirelessly communicating with said badges; providing dispenser beacons, each associated with a sanitization dispenser, and each of the said dispenser beacon having a transmitter/receiver capable of wirelessly communicating with said badges; changing the state of each of the said badges from said first-state to said second-state when located in a certain proximity to a food prep table beacon, and transmitting a status change signal indicating such first-to-second-state change to the food prep table beacon with the badge identification signal; changing the state of each of the said badges from said second-state to said third-state when located in a certain proximity to a food prep table beacon different from the food prep table beacon which caused the badge to change from the first-state to the second-state, and transmitting a status signal indicating such second-to-third-state change to the food prep table beacon with the badge identification signal; changing the status of a each of the said badges from the second-state or third-state to the first-state when the person has performed a sanitization procedure at the sanitization dispenser.

12. The method according to claim 11, including wirelessly communicating with a central unit, and wherein the food prep table beacon transmits the identification signal of the badge, and the current state of the badge, to the central unit, in response to the badge coming within a certain proximity with a the food prep table beacon.

13. The method according to claim 11, including wirelessly communicating with a central unit, and wherein the dispenser beacon transmits the identification signal of the badge, and the current state of the badge, to the central unit, in response to the badge coming within a certain proximity with the dispenser beacon.

14. The method of claim 11, comprising illuminating badges' indicia with three different color lights respectively representing the first-, second-, and third-states.

15. The method of claim 11, comprising generating an audio signal by the badges in response to the dispenser beacon causing a change in the badge state from a second- or third-state to a first-state.

16. The method of claim 11, wherein, in response to any one of the badges coming in a certain proximity to any one of the dispenser beacons, the badge transmitter/receiver and the dispenser transmitter/receiver increase their respective transmitter/receiver ranges to permit communication over a wider communication-range, and wherein the respective badge and dispenser beacon lock communication to the exclusion of other badges and dispenser beacons, until communication between the badge and dispenser beacon is complete.

17. The method of claim 11, wherein, in response to any one of the badges coming in close proximity to any one of the prep table beacons, the badge transmitter/receiver and the prep table beacon transmitter/receiver increase their respective transmitter/receiver ranges to permit communication over a wider communication-range, and wherein the respective badge and prep table beacon lock communication to the exclusion of other badges and prep table beacons, until communication between the badge and prep table beacon is complete.

18. The method of claim 11, wherein any one of the badges in a second-state changes to the third-state if the badge leaves the certain proximity to any one of the food prep tables and remains out of that proximity for a certain time period and re-enters that certain proximity after the certain time period.

19. The method of claim 11, wherein any one of the badges in the first-state changes to the second-state after a certain time period has elapsed without the badge-wearer performing the sanitization procedure.

20. The method of claim 11, wherein any one of the badges in the second-state changes to the third-state after a certain time period has elapsed without the badge-wearer performing the sanitization procedure.

* * * * *